US006582531B2

(12) United States Patent
Warburton

(10) Patent No.: US 6,582,531 B2
(45) Date of Patent: Jun. 24, 2003

(54) X-RAY TUBE AND METHOD OF MANUFACTURE

(75) Inventor: Don Warburton, Sandy, UT (US)

(73) Assignee: Varian Medical Systems, Inc., Palo Alto, CA (US)

( * ) Notice: Subject to any disclaimer, the term of this patent is extended or adjusted under 35 U.S.C. 154(b) by 0 days.

(21) Appl. No.: 09/934,265

(22) Filed: Aug. 21, 2001

(65) Prior Publication Data

US 2002/0003862 A1 Jan. 10, 2002

Related U.S. Application Data

(62) Division of application No. 09/437,943, filed on Nov. 10, 1999, now Pat. No. 6,282,262.

(51) Int. Cl.[7] ..... C23C 8/06

(52) U.S. Cl. ..... 148/280; 148/282; 148/286; 148/553; 427/328; 378/119; 378/140

(58) Field of Search ..... 148/242, 280, 148/282, 286, 553; 427/328; 378/119, 140

(56) References Cited

U.S. PATENT DOCUMENTS 3,357,824 A * 12/1967 Saarivirta ..... 148/411
3,573,110 A * 3/1971 Ence ..... 148/411
4,238,706 A 12/1980 Yoshihara et al. ..... 313/330
4,537,745 A * 8/1985 Hassler et al. ..... 219/121.38
4,964,148 A * 10/1990 Klostermann et al. ..... 378/121
5,090,475 A 2/1992 Marx ..... 165/10
5,317,618 A 5/1994 Nakahara et al. ..... 378/161
5,557,927 A * 9/1996 Chiang et al. ..... 60/257

FOREIGN PATENT DOCUMENTS

JP 2-272400 11/1990

* cited by examiner

*Primary Examiner*—John Sheehan
*Assistant Examiner*—Andrew L. Oltmans
(74) *Attorney, Agent, or Firm*—Workman, Nydegger & Seeley

(57) ABSTRACT

The present invention relates to structures within an x-ray device including an x-ray can, an x-ray can window frame insert, a rotor sleeve, and a bearing support assembly for a rotor structure. The various structures are fabricated from a chromium alloy of copper that is essentially oxygen free copper having a minor amount of chromium, the combination of which imparts desirable qualities to the x-ray device structures, including efficient heat sink and emissivity qualities that are beneficial in an x-ray device environment. In one preferred embodiment of the present invention, oxygen free high conductivity (OFHC) copper is melted in an RF furnace in the presence of a minor amount of chromium and is either ingot cast or powder metallurgically cast into a desired article and further fabricated into a finished article.

16 Claims, 4 Drawing Sheets

X-RAY TUBE AND METHOD OF MANUFACTURE

RELATED APPLICATION INFORMATION

This application is a divisional application of U.S. patent application Ser. No.: 09/437,943, filed Nov. 10, 1999, and now U.S. Pat. No. 6,282,262 B1. That application is incorporated herein by reference in its entirety.

BACKGROUND OF THE INVENTION

1. The Field of the Invention

The present invention relates to x-ray devices. More particularly, the present invention relates to x-ray tubes having components constructed of a copper chromium alloy material for enhanced thermal management and thermal stability.

2. The Relevant Technology

X-ray devices are widely used in applications ranging from medical radiology to industrial diagnostics. A common problem encountered in the design and operation of x-ray tubes used in such devices relates to the management of the extremely high temperatures that are present. Heat management is particularly troublesome in the region of the rotating anode and rotor assembly. During operation, extreme temperatures are generated at the anode's focal track, which are then transferred to other parts of the rotor assembly. These temperatures can adversely affect the operating life of the x-ray tube. For instance, bearings that assist the rotating anode to rotate can fail, and other parts of the rotor assembly are prone to failure from the constant thermal expansion and contraction.

The problems related to high temperatures produced in the x-ray tube have been partly addressed by providing an emissive coating on the rotor portion of the x-ray tube assembly. Preferably, the coating possessed thermal characteristics that allowed components of the x-ray tube—such as the rotor—to operate more satisfactorily under the extreme operating temperatures. For example, in the past a thin, oxygen-deficient titanium oxide layer was applied onto the rotor skirt by a plasma spraying process. However, this coating has not been entirely satisfactory—especially over longer operating periods. In particular, the repeated thermal cycling of an x-ray tube structure tends to cause an emissive coating of this sort to flake or spall away from the rotor skirt. This debris can then contaminate other components within the x-ray tube, and lead to premature failure of the tube. Moreover, there often is a thermal mismatch between rotor material and the coating material, which tends to weaken the bond between the two materials as they thermally expand. Again, this leads to the undesired situation of the coating flaking or spalling and contaminating the x-ray tube.

Use of such coatings can also give rise to other problems. For instance, during the manufacturing of the x-ray tube device, difficulties are often encountered in getting the coating to properly adhere to the rotor substrate and/or the other x-ray components. To ensure proper adhesion typically requires an additional manufacturing step prepare the rotor substrate. For example, the rotor substrate may be "roughened" by blasting the substrate with a grit material. This process is undesirable for several reasons. First, the need for an extra manufacturing step adds cost and complexity to the overall manufacturing processes. Second, some of the grit material used in the roughening process invariably will become physically embedded within the rotor substrate material. This grit material can then shed from the rotor during operation of the x-ray tube, especially after repeated use. Again, release of such foreign matter within the sealed environment of an x-ray tube leads to contamination and premature failure of the tube.

As noted, other components within the x-ray tube are also subject to various problems associated with the high operating temperatures. For example, a bearing support structure is often connected to a "nose" portion of the rotor which is in turn connected to the rotating anode. The bearing support structure is typically disposed within the rotor sleeve portion and, due to its close proximity to the rotating anode, is also exposed to extreme temperature fluctuations. Typically, the bearing support structure is made of a copper material to take advantage of its high thermal conductivity qualities. However, copper can deform under the significant transient thermal stress that is experienced in the bearing support structure. A deformed rotor bearing support structure causes problems such as hindered and/or unbalanced rotation, resulting in a cathode-anode misalignment. This situation compromises the quality of the x-rays that are emitted from the anode. Moreover, any type of unbalanced rotation results in vibration of the x-ray tube, which increases operating noise of the x-ray device, and ultimately can render the x-ray tube inoperable.

One approach to address some of the problems encountered when using copper as a rotor bearing support material as been use a alternative material, such as stainless steel. However, although stainless steel exhibits better structural rigidity in the presence of high temperatures and thus resists deformation, stainless steel has a lower thermal conductivity. As such, unacceptably high temperatures can be present within the rotor and bearing assembly.

Another significant challenge for heat management in an x-ray device relates to the dissipation of the heat from the x-ray tube to the surrounding structure. Typically, heat is transferred from the x-ray tube to a heat-transfer fluid medium such as a dielectric oil that is disposed within another enclosure, sometimes referred to as an x-ray tube "can" or housing. This housing or can must also exhibit suitable heat transfer characteristics. If the can is not an efficient heat transfer medium, any efficiencies or improvements achieved for heat transfer in the x-ray tube can be neutralized by the can itself.

Typically, the can housing is made of copper or stainless steel. During operation of the x-ray tube, high temperatures are especially prevalent at the window area of the can, which is where the x-ray signals are emitted. Problems can arise in the event that the material that is adjacent to the window does not efficiently draw heat away from the window.

Thus, what is needed in the art is an x-ray tube that can withstand the destructive effects of extreme operating temperatures generated at the rotating target anode. In particular, the x-ray tube components located adjacent to the anode, such as the rotor and rotor skirt, should possess desirable thermal characteristics. Moreover, any solution should reduce or eliminate the occurrence of any foreign debris being released within the evacuated enclosure, such as from flaking or spalling of any coating materials, or from any materials used during the manufacturing process. In addition, it would be an advancement in the art to provide a x-ray tube housing or "can" that is not subject to warpage and structural damage in the presence of high temperatures, and which can efficiently dissipate heat present at the window area.

BRIEF SUMMARY AND OBJECTS OF THE INVENTION

It is therefore a primary object of the present invention to provide an x-ray device and manufacturing method in which alloys having superior operating characteristics in the presence of extreme temperatures and temperature fluctuations are utilized.

A related objective of the present invention is to provide a material and a method of manufacture that can be used to construct components of an x-ray tube device and that improves the thermal characteristics of the components.

Yet another objective of the present invention is to provide an x-ray tube having components that are not subject to flaking and spalling of the outer surface, even when exposed to the extremely high operating temperatures within an x-ray tube.

Another object of the present invention is to provide components for use in an x-ray tube that can be manufactured without introducing any foreign debris, such as grit, into the x-ray tube.

Still another objective of the present invention is to provide an x-ray tube that has components that have an outer thermal emitter layer or coating that possesses superior thermal characteristics.

Another related objective is to provide an x-ray tube and method of manufacture in which an outer thermal coating or layer is easily applied to components of the x-ray tube.

These and other objects and features of the present invention will become more fully apparent from the following description and appended claims, or may be learned by the practice of the invention as set forth hereinafter. Briefly summarized, the present invention utilizes a chromium alloy of copper material to construct components of an x-ray device that require superior thermal characteristics. For instance, in presently preferred embodiments, the chromium alloy of copper material is used to construct the rotor sleeve, or "skirt" portion of the rotor assembly. The rotor sleeve is then treated, for instance in a wet $H_2$ environment, so that the sleeve has an oxidized, or "greened" external surface. The resulting rotor sleeve exhibits several desirable characteristics. First, the chromium alloy of copper material is structurally sound, even when exposed to the extremely high temperatures of an operating x-ray tube. Second, the outer layer provided by the greened surface is efficient thermal emitter and thus transfers heat away from the rotor assembly. Both advantages result in a rotor assembly that has a longer operational life.

A rotor sleeve constructed of the chromium alloy of copper material also resists any flaking or spalling of the outer surface due to the integral structure of the sleeve and its greened emitter surface. This reduces the amount of contaminant that is present within the evacuated x-ray tube, thereby reducing opportunity for tube failure and increasing the overall operational life of the tube.

Alternative embodiments of the present invention also are directed to a composite structure that uses the inventive chromium alloy of copper as a plasma-sprayed coating upon an essentially oxygen free copper substrate. The plasma-sprayed chromium alloy of copper is then greened in a wet $H_2$ environment. This provides an essentially oxygen free substrate, a copper alloy coating disposed upon the substrate comprising the inventive chromium alloy of copper, and a thermal oxidation layer formed upon the coating. Again, x-ray tube components, such as a rotor sleeve, having this configuration possess superior thermal characteristics.

Other embodiments utilize the chromium alloy of copper in other x-ray tube components. For example, the material can be used in the bearing support structure that is used to provide rotation to the anode disk. Again, the resulting bearing support structure possesses a significantly improved resistance to thermal deformation, and at the same time maintains an efficient high thermal conductivity. This reduces the amount of heat that is conducted to the ball bearing assembly, and reduces the incidence of heat-induced failure that may otherwise occur.

Other embodiments of the present invention relate to the application of the chromium alloy of copper to the outer x-ray tube housing or "can" portion of the x-ray tube device. For example, in one embodiment, the alloy is used within the window frame insert of a stainless steel can housing. This window frame insert acts as an efficient heat sink that draws heat away from the x-ray window itself. Again, this thermal characteristic results in a longer lasting x-ray tube device.

The chromium alloy of copper can also be used in other areas of the x-ray tube can housing. In one preferred embodiment, the entire can is constructed of the chromium alloy of copper, and is then treated so as to provide the outer thermal oxidation layer. Again, the resulting can provides distinct advantages of thermal heat management and resistance to deformation.

Embodiments of the present invention also relate to an improved method of making the inventive chromium alloy of copper. One preferred method includes providing essentially oxygen free copper as a major component with unavoidable impurities and combining it with chromium as a minor component with unavoidable impurities. The combination of copper and chromium is placed into a container in an inert atmosphere and heated in order to achieve a chromium copper solution. Embodiments of the present invention also involve methods of using the chromium alloy of copper, including the casting of articles of manufacture therefrom and also atomizing the chromium copper solution to obtain a metal powder as a stock material for forming preferred articles by powder metallurgical techniques.

BRIEF DESCRIPTION OF THE DRAWINGS

In order that the manner in which the above-recited and other advantages and objects of the invention are obtained, a more particular description of the invention briefly described above will be rendered by reference to a specific embodiment thereof which is illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

The present invention relates to an x-ray device having at least one structural component that is comprised of a chromium alloy of copper material. Use of the chromium alloy of copper in various x-ray device structures has overcome several problems that existed in the art of x-ray devices. Namely, the chromium alloy of copper is particularly well suited for use within an x-ray tube due to its ability to withstand deformation, even in the presence of high temperatures. Moreover, when greened in a wet $H_2$ atmosphere, the chromium alloy of copper is provided with an outer layer that acts both as a heat sink and as a thermal emitter body. This provides the corresponding x-ray tube component with superior heat management characteristics, In a first embodiment of the present invention, a chromium alloy of copper is used as the primary material for construction of selected components of an x-ray tube device. Preferably, the chromium alloy of copper is made of an essentially oxygen free copper. By "essentially oxygen free," it is meant that the copper component in the chromium alloy of copper has an oxygen impurity concentration less than 100 ppm. In preferred embodiments, the oxygen impurity concentration is less than 10 ppm. One suitable essentially oxygen free copper that may be uses as an alloy component, or as a substrate material, is oxygen free high conductivity (OFHC) copper that is commercially available. Likewise, the chromium portion of the chromium alloy of copper has an oxygen impurity level of about 100 ppm or less, and again is preferably about 10 ppm or less.

In a presently preferred embodiment, the essentially oxygen free copper portion of the alloy is present as a major component, and the chromium is present as a minor component. The balance of the alloy is unavoidable impurities. Preferably, the oxygen free copper is present in a range from about 90% to about 99.9%, and the remaining balance is chromium and unavoidable impurities. Accordingly, the preferred balance of chromium is in a corresponding range from about 10% to about 0.1%. One particularly preferred chromium alloy of copper is essentially oxygen free copper in an amount of about 98.5%, chromium about 1.5%, and the balance unavoidable impurities.

Figure 1:
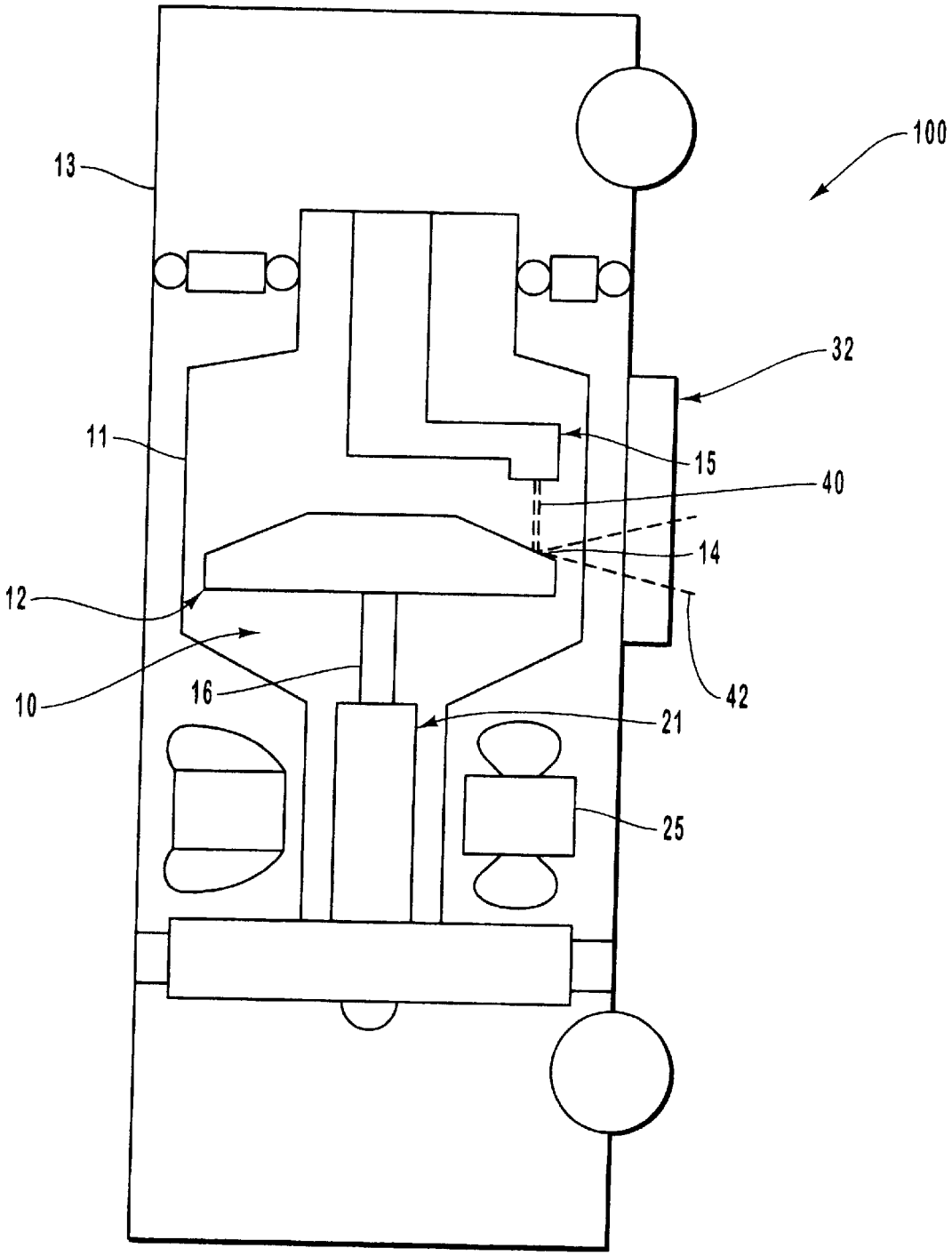
FIG. 1 is a simplified schematic representation of an x-ray tube assembly.

Reference is first made to FIG. 1, which illustrates an exemplary x-ray tube device, designated generally at 100, that is suitable for use in connection for various embodiments of the present invention. Generally summarized, the x-ray tube device 100 includes an outer housing, or "can" 13. Disposed within the can 13 is an evacuated glass housing 11, which encloses an anode assembly 10 and a cathode 15. The anode assembly 10 includes a rotating anode 12 that is connected to a rotor shaft 16. The rotating anode 12 is spaced apart from and oppositely disposed from a cathode 15. As is well known, the cathode 15 includes a cathode head and a filament (not shown) that is connected to an appropriate power source. The anode and the cathode are connected within an electrical circuit that allows for the application of a voltage potential (ranging from about ten thousand to in excess of hundreds of thousands of volts) between the anode (positive) and the cathode (negative). The high voltage differential causes a thin stream, or beam, of electrons, designated at 40, to be emitted at a very high velocity from a portion of the cathode 15 towards an x-ray "target" 14 that is positioned on the rotating anode target disk 12. The x-ray target has a target surface (sometimes referred to as the focal track) that is comprised of a refractory metal. When the electrons strike the target, the kinetic energy of the striking electron beam is converted to electromagnetic waves of very high frequency, i.e., x-rays. The resulting x-rays, designated at 42, emanate from the anode target, and are then collimated through a window 32 for penetration into an object, such as an area of a patient's body. As is well known, the x-rays that pass through the object can be detected and analyzed so as to be used in any one of a number of applications, such as x-ray medical diagnostic examination or material analysis procedures.

The rotating anode disk 12 (also referred to as the rotary target or the rotary anode) is operably connected to the rotating shaft 16, which is connected at an opposite end to a supporting rotor assembly 21. The shaft 16 and the anode disk 12 are rotated by any suitable means, such as a stator motor 25. The stator motor is used to rotate the disk at high speeds (often in the range of 10,000 RPM), thereby causing the focal track to rotate into and out of the path of the electron beam. In this way, the electron beam is in contact with specific points along the focal track for only short periods of time, thereby allowing the remaining portion of the track to cool during the time that it takes the portion to rotate back into the path of the electron beam.

As noted, the need to continuously accelerate and rotate the disk at such high speeds in the presence of extremely high temperatures can give rise to a number of problems. For instance, while the rotation of the track helps reduce the amount and duration of heat dissipated in the anode target, the focal track is still exposed to very high temperatures—often temperatures of 2500° C. or higher are encountered at the focal spot of the electron beam. This heat is transferred to other portions of the x-ray tube assembly, including the components of the rotor assembly 21, the outer "can" 13 housing, and the window 32. The high temperatures cause extreme thermal stresses to occur in these, and other portions of the x-ray tube 100, resulting in a shorter operational life and even failure of the x-ray tube. As will be further discussed and described, improved thermal characteristics are provided within these various x-ray tube components by utilizing the above-described chromium alloy of copper.

Figure 2:
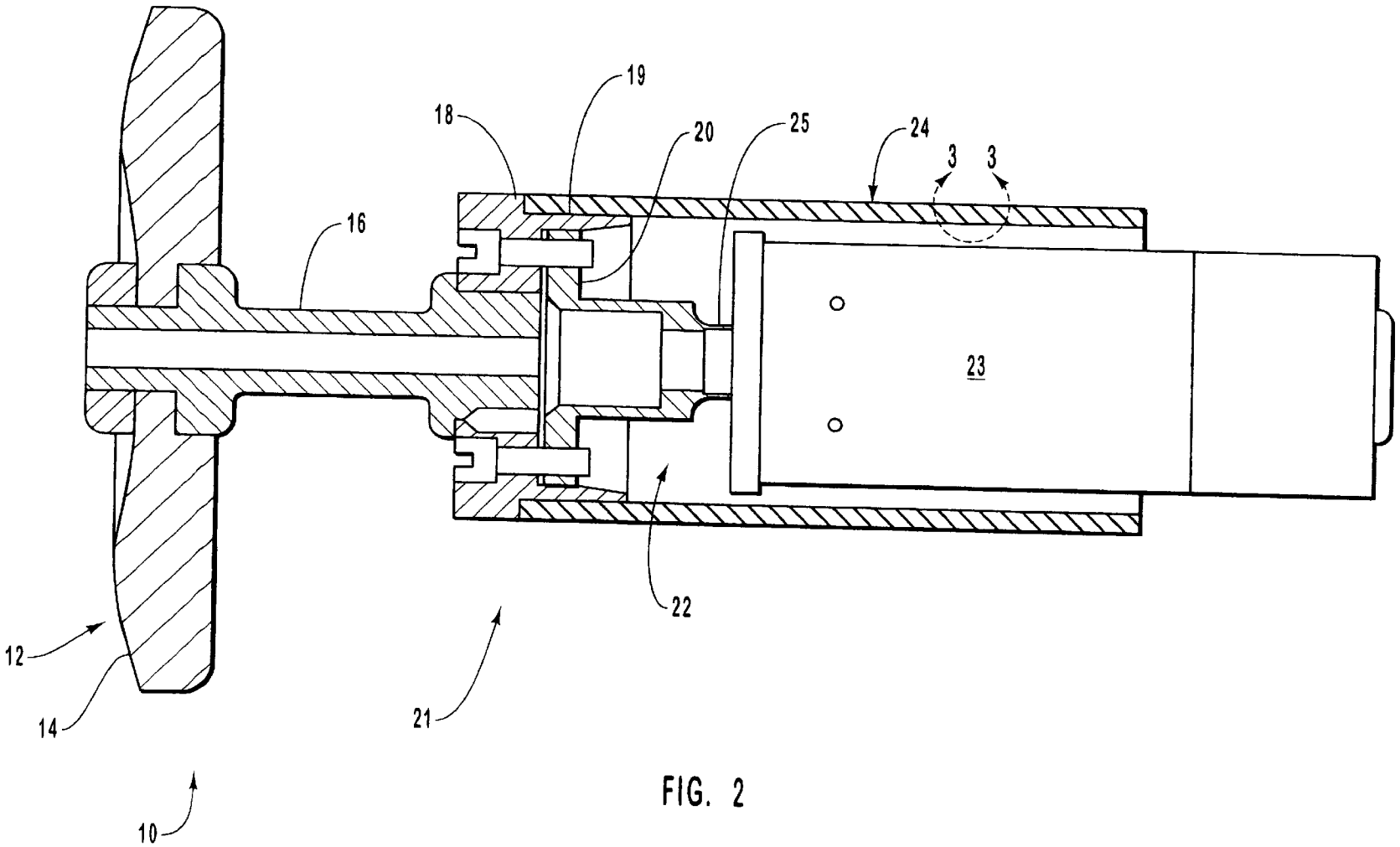
FIG. 2 is a cross-sectional elevational view of a rotating anode assembly portion of an x-ray tube of the sort illustrated in FIG. 1, including the rotating anode, and the rotor assembly.

Reference is next made to FIG. 2, which is an elevational cross-section view of the rotating anode assembly 10. As is shown, the rotating anode 12 with a focal track 14 is affixed to the rotor shaft 16. The opposite end of the shaft 16 is connected to a rotor hub 18 or nose portion. The rotor hub 18 is then mounted to a rotor sleeve 24 (sometimes referred to as a rotor "skirt") via an interface 19. Partially disposed within the rotor sleeve 24 is a bearing support assembly, designated generally at 22. The bearing support assembly 22 includes a bearing hub 20, which is connected to a shaft 25 that is rotatably supported on a bearing support surface provided by bearings (not shown) disposed within the bearing housing 23.

As noted, during operation of the x-ray tube device 100 a significant amount of heat is radiated from the rotating anode 12. Unavoidably, a significant fraction of this heat is conducted along the rotor shaft 16, into the rotor hub 18 and further into rotor sleeve 24 and bearing hub 20 and other portions of the bearing support assembly 22. The extreme temperature fluctuations experienced within the bearing support assembly 22 and various other components of the rotating structure can, especially over repeated operations, degrade the operating life of the components—especially in the absence of effective heat management. Accordingly, rotor sleeve 24 is typically configured as a heat conductor to act as a heat sink and thereby draw and dissipate heat away from bearing support assembly. Moreover, in preferred embodiments of the present invention, the rotor sleeve 24 is constructed with the chromium alloy of copper material or, alternatively, of a composite containing a chromium alloy of copper described above. This provides for further improvement in management and dissipation of heat within the rotor assembly. In a similar fashion, the chromium alloy of copper may also be employed in constructing other parts of the x-ray tube 100. For example, portions of the bearing support assembly 22, such as the external structure 23 that encloses the bearings (not shown), can also be constructed with the chromium alloy of copper.

Figure 3:
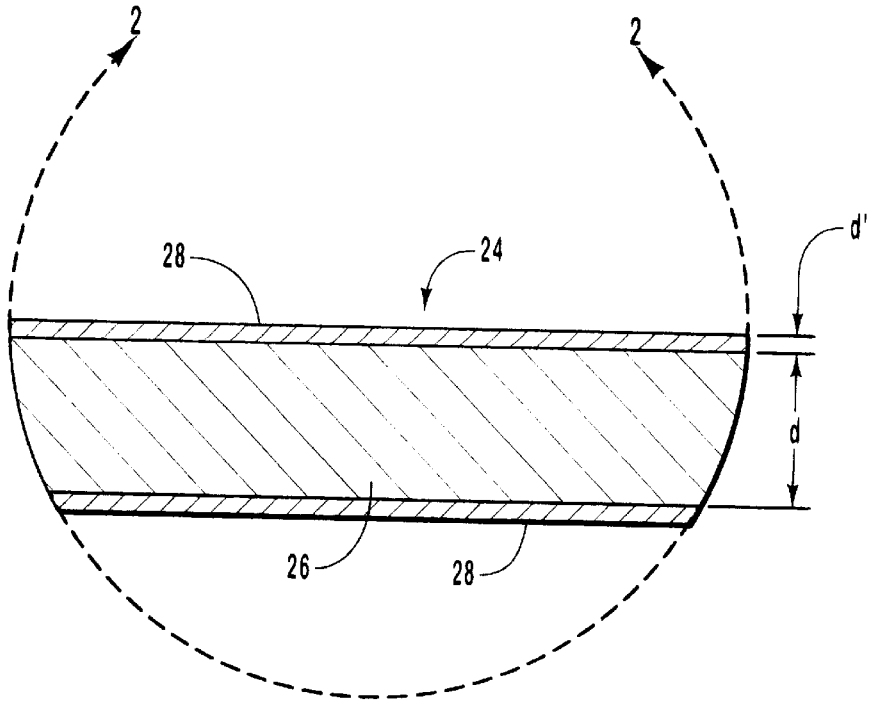
FIG. 3 is a detail section taken from FIG. 2 illustrating in cross section embodiments of the present invention.

According to one embodiment of the present invention, the rotor sleeve 24 portion of the rotor assembly 21 is made of the chromium alloy of copper and may be provided in the preferred concentration ratios as set forth above. FIG. 3 is a detail section taken along the line 3—3 from the rotor sleeve 24 in FIG. 2. In FIG. 3, the rotor sleeve 24 is a composite structure comprising an alloy substrate 26 of the essentially oxygen free copper in solid solution with chromium according to the concentration ratios set forth above.

In the illustrated embodiment, there is a greened chromium oxide layer 28 disposed upon the alloy substrate 26. The greened chromium oxide layer 28 has distinct qualities that provide advantages—especially with respect to thermal management. The greened chromium oxide layer 28 is preferably formed by treating alloy substrate 26 in a wet $H_2$ environment under conditions sufficient to oxidize at least some chromium in alloy substrate 26 to form an oxide layer that is integral to alloy substrate 26. By "integral" it is meant that vertical chemical bonds between greened oxide layer 28 and alloy substrate 26 are stronger than laterally disposed chemical bonds between chromium oxide molecules within greened oxide layer 28. The vertical bonds may be stronger by a factor of about 1.1, and in a preferred embodiment are about 2.5 or greater.

The method of treating the alloy substrate 26 includes setting the substrate 26 in a vessel, such as a heating oven or furnace, and contacting the substrate 26 with wet $H_2$ in a temperature range from about 100° C. to about 1200° C. A contacting time in a range from about 0.1 h to about 5 h may be used for the formation of greened oxide layer 28.

In one presently preferred process, the alloy substrate 26 comprising 98.5% OFHC copper and 1.5% chromium is placed in a wet $H_2$ environment in a temperature range from about 1,000° C. to about 1,050° C. and for a contacting time in a range from about 1 hour to about 2 hours. Other times and/or temperatures could also be used. Following the treatment, the rotor sleeve 24 as depicted in FIG. 3 has a greened chromium oxide layer 28 disposed on both sides thereof.

In an exemplary embodiment, the rotor sleeve 24 has a cross-sectional dimension—indicated as dimension 'd' in FIG. 3—of about 100 mils. In addition, the width of the greened chromium oxide layer 28—indicated as dimension 'd' in FIG. 3—has a value in a range from about 1 mil to about 30 mils, and preferably from about 3 mils to about 10 mils. Specifically, the greened chromium oxide layer 28 is of a dimension 'd' so that it doesn't spall, flake, or otherwise disintegrate for a minimum operational lifetime—which in one preferred embodiment is in excess of 25,000 scan seconds—even when exposed to the extreme temperature fluctuations and high rotational speeds of the x-ray tube 100.

Figure 4:
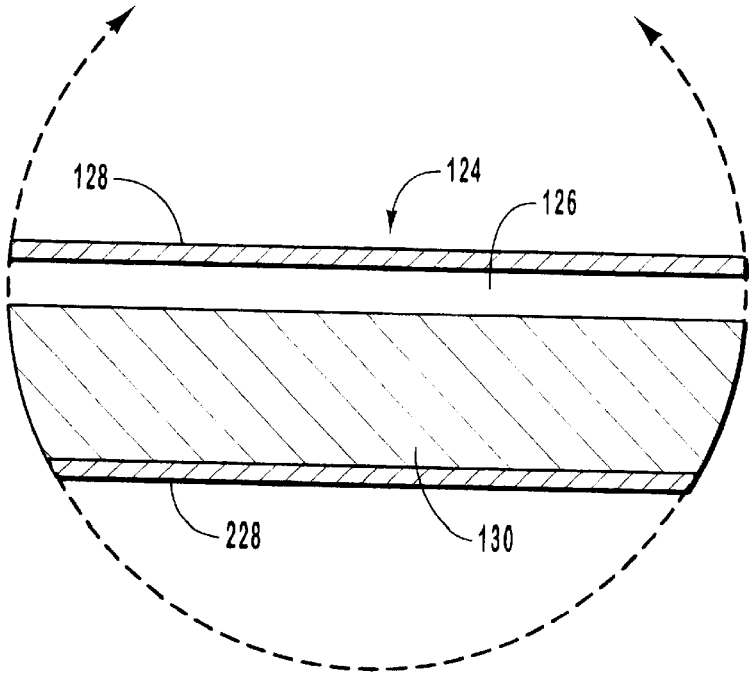
FIG. 4 is a detail section taken from FIG. 2 illustrating an alternative embodiment of the present invention.

FIG. 4 is an alternative embodiment of the present invention as depicted by a detail section taken also along the line 3—3 of rotor sleeve 24 in FIG. 2. As can be seen in FIG. 4, a rotor sleeve 124 includes an essentially oxygen free copper substrate 130 and an alloy substrate 126 of chromium alloy of copper set forth herein. Alloy substrate 126 is formed upon copper substrate 130 by any suitable means. Preferably, alloy substrate 126 is plasma flame coated onto at least one surface of copper substrate 130. In addition, a greened chromium oxide layer 128 and 228 can be disposed upon the alloy substrate 126 in the manner previously described.

Thermal matching between copper substrate 130 and alloy substrate 126 is a distinct advantage of this embodiment. In the temperature fluctuation range experienced for rotor sleeve 124, particularly at rotor hub-rotor sleeve interface 19, thermal mismatch is less than about 10%, and preferably less than about 0.1%. The thermal rates of expansion and contraction are thus very similar between the two materials, thereby eliminating problems that are encountered with materials having dissimilar rates of thermal expansion.

Figure 5:
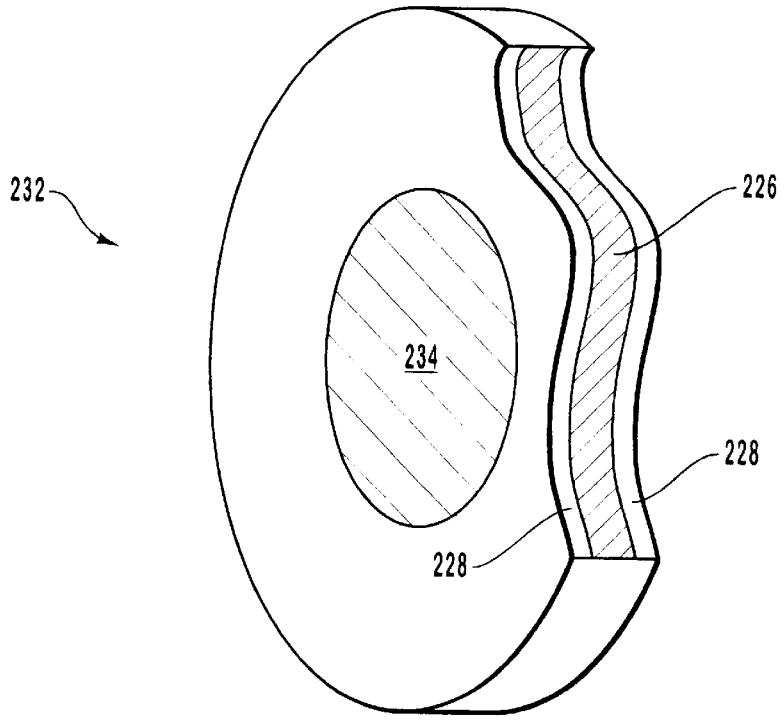
FIG. 5 is a partial cut-away, elevational perspective view of an x-ray window insert assembly according to yet another embodiment of the present invention.
Figure 6:
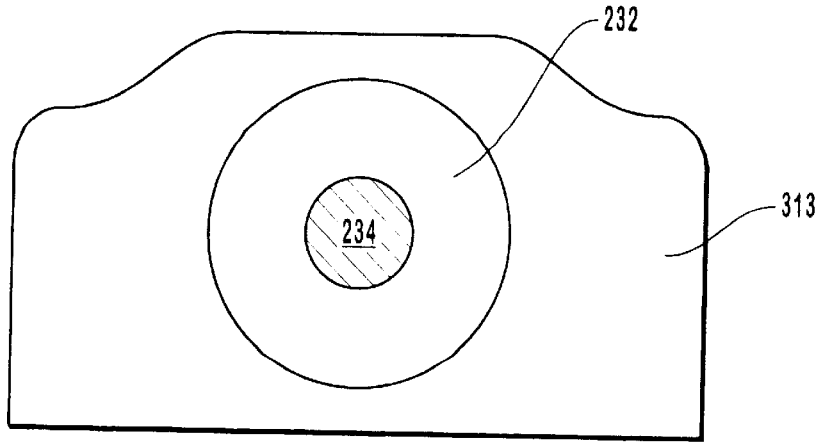
FIG. 6 is an elevational side view of a portion of an x-ray tube housing and an x-ray window insert assembly formed within the housing.

FIGS. 5 and 6 together illustrate yet another embodiment of the present invention. FIG. 5 illustrates a partial cut-away, elevational perspective view of an x-ray window frame insert 232, that would be disposed within a x-ray tube housing or can 313, which is designated in FIG. 6 (13 in FIG. 1). The frame insert 232 is braised, welded or otherwise integrally attached within the x-ray can 313, which is formed from any suitable material, such as stainless steel. Insert 232 has an x-ray window 234 affixed in the middle thereof, which permits passage of the x-ray signal. In the embodiment shown, x-ray window 234 is made of beryllium Be, although other x-ray transmissive materials could also be used. The window 234 is installed within the can at a point adjacent to the anode 12, as is illustrated in FIG. 1. The portion of the x-ray window frame insert 232 that is adjacent to the window 234 is comprised of an alloy substrate 226, formed from the chromium alloy of copper previously described. In the illustrated embodiment, a greened chromium oxide layer 228, preferably formed in a wet $H_2$ environment in the manner previously described, is disposed upon the alloy substrate 226. As excessive amounts of heat are generated at the x-ray window 234, alloy substrate 226 acts as an efficient heat transfer medium and greened chromium oxide layer 228 acts as an efficient thermal emitter substance to ultimately reject heat from the x-ray window 234.

In an alternative embodiment, x-ray window frame insert 232 and can 313 comprise an integral unit made of the inventive chromium alloy of copper with at least one surface thereof treated to form greened chromium oxide layer 228. Preferably, a greened chromium oxide layer 228 is formed on an inner surface of the can 313 (13 in FIG. 1) along that portion of the surface that is adjacent to the rotor sleeve 24 (FIG. 2). More preferably, a greened chromium oxide layer 228 is disposed on both surfaces, i.e., the inner and outer surfaces of the can 313.

An example is provided for demonstration of the preparation of the inventive alloy. A special alloy was created by casting 1.5% chromium chips with the remainder being OFHC copper base stock. The chromium chips and OFHC copper base stock were placed in a crucible and RF heated under a vacuum environment until melting was complete and a liquid solution of the inventive chromium alloy of copper was formed. The alloy was cast and subjected to a wet $H_2$ environment at about 1,000° C. for about 2 hours. The wall of the cast article had a structure as depicted in FIG. 3, wherein the treated inventive chromium alloy of copper substrate 26 had a greened chromium oxide layer 28. The greened chromium oxide layer 28 exhibited a dark green color and was observed to be substantially integral with alloy substrate 26. In particular, the greened chromium oxide layer 28 did not exhibit any flaking or spalling.

The chromium alloy of copper may also be formed into a metal powder for use as a stock material in powder metallurgical article formation techniques. Where rotation rates experienced in an x-ray device are applied to articles made of the inventive alloy, tensile stresses are experienced. When these stresses are coupled with the temperature fluctuations experienced in an x-ray device, the possibility of failure increases. A structure such as a rotor sleeve may be powder metal forged to gain advantages of a grain structure that is finer and more uniform that an ingot-cast and cold- or hot-worked article.

In one embodiment of the present invention, a rotor sleeve 24, for example, is made by powder metallurgical techniques known in the art, but the chromium alloy of copper is used. The rotor sleeve may be cold pressed, hot pressed, or hot isostatic pressed. These techniques are known in the art and one of ordinary skill in the art may apply known pressing techniques to the inventive chromium alloy of copper.

In one embodiment, the chromium alloy of copper is powder metallurgically forged into a rotor sleeve and then a radial stress is applied by use of a mandrel that is inserted into the sleeve. The mandrel is made to expand the rotor sleeve while the sleeve is under a tensile and thermal load. The tensile load supplied by the mandrel can cause the rotor sleeve to expand by about 10% (increased radius). Preferably, the tensile load supplied by the mandrel causes the rotor sleeve to expand by about 5% or less. Presently preferred temperatures imposed on the rotor sleeve may be in a range from about room temperature to about 95% of the alloy liquidus temperature. Also, one preferred treatment time is in a range from about 30 seconds to about 1 hour. Under these preferred conditions, elongated grain growth is perpendicular to the major axis of the sleeve. The elongated grain growth provides an anisotropic quality in the rotor sleeve to resist tensile rupture during heated rotation thereof.

Distinct advantages exist with the present invention. With the x-ray device rotor assembly, the rotor sleeve as made of the chromium alloy of copper does not have the prior art problems of flaking or spalling or of the shedding of grit. Additionally, because the entire rotor sleeve may be made of the chromium alloy of copper, the chromium alloy imparts desirable deformation resistance even under extreme transient thermal loads that are imposed upon the rotor assembly. Additionally, where the rotor is made of the chromium alloy of copper, heat conduction out of the nose of the rotor is greater than with a stainless steel rotor coated with copper and/or another high emissivity coating and the rotor retains the deformation resistant qualities of the inventive alloy.

Where the present invention is embodied as an OFHC copper rotor substrate that has been plasma spray coated with the chromium alloy of copper, the advantage of this spraying operation over the prior art is that the mismatch between the coefficient of thermal expansion of the substrate and of the sprayed on coating is insignificant to the degree that detrimental spalling and flaking of the coating is greatly reduced or eliminated. Additionally, where the sprayed-on coating is greened in a wet $H_2$ environment, detrimental flaking or spalling of the coating in a greened condition is reduced or eliminated.

Another advantage of the present invention is found in the embodiment of the bearing support that is made of the chromium alloy of copper material. Because of the strengthening effect of chromium in the amount with substantially oxygen free copper, the bearing support exhibits resistance to thermal deformation equivalent or superior to that of a bearing support made of stainless steel or the like. Additionally, along with the superior deformation resistance, the chromium alloy of copper exhibits superior thermal conductivity qualities that facilitate the purpose of the x-ray device.

Another advantage exists in the present invention where the chromium alloy of copper is embodied in an x-ray window insert for the x-ray can. Where the x-ray window insert is made of the chromium alloy of copper material, heat generated at the window is efficiently drawn away therefrom into the x-ray window insert. Where the entire can is made of the inventive chromium alloy of copper, heat generated at the x-ray window is efficiently drawn away in a manner that does not experience a thermal dam as in the previous embodiment where the x-ray window insert makes a junction with a can made of stainless steel or the like.

The present invention may be embodied in other specific forms without departing from its spirit or essential characteristics. The described embodiments are to be considered in all respects only as illustrated and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A method of forming a composite structure for use in an x-ray tube assembly, the method comprising the steps of:

providing a substrate formed substantially in the shade of a component of an x-ray tube, the substrate comprising oxygen free copper;

depositing a coating on the substrate, the coating comprising oxygen free copper as a major component, and chromium as a minor component; and forming a layer on the coating by converting at least some of the chromium to an oxide thereof.

2. A method as defined in claim 1, wherein the forming a layer step comprises:

oxidizing at least some of the chromium in the coating in a wet $H_2$ environment.

3. A method as defined in claim 1, wherein the forming a layer step comprises:

oxidizing at least some of the chromium in the coating in a wet $H_2$ environment, wherein the wet $H_2$ environment is at a temperature range from about 100° C. to about 1,100° C.

4. A method as defined in claim 1, wherein the forming a layer step comprises:

oxidizing at least some of the chromium in the coating in a wet $H_2$ environment for a time period in the range from about 0.1 hour to about 5 hours.

5. A method of making a chromium alloy of copper for use in an x-ray tube, the method comprising the steps of:

providing essentially oxygen free copper as a major component;

providing chromium as a minor component;

placing the copper and the chromium into a container having an inert atmosphere;

heating the copper and the chromium to achieve a chromium alloy of copper solution; and forming the chromium alloy of copper solution into an x-ray tube component.

6. A method as defined in claim 5, further comprising the step of cooling the chromium alloy of copper solution to a solid.

7. A method as defined in claim 5, wherein the component is an x-ray tube rotor sleeve component.

8. A method as defined in claim 5, wherein the component is an x-ray tube bearing support component.

9. A method as defined in claim 5, wherein the component is an x-ray tube window frame insert.

10. A method as defined in claim 5, wherein the component is an x-ray tube housing.

11. A method as defined in claim 5, wherein the essentially oxygen free copper is OFHC copper in a concentration range from about 90% to about 99.9%, and the chromium is in a concentration range from about 0.1% to about 10%.

12. A method of making a chromium alloy of copper for use in an x-ray tube, the method comprising the steps of:

providing essentially oxygen free copper as a major component;

providing chromium as a minor component;

placing the copper and the chromium into a container having an inert atmosphere;

heating the copper and the chromium to achieve a chromium alloy of copper solution; and atomizing the chromium alloy of copper solution to obtain a solid solution powder.

13. A method as defined in claim 12, further comprising the step of forming a quantity of the solid solution powder into an x-ray device component.

14. A method as defined in claim 13, wherein the step of forming is carried out by pressing the solid solution power into the x-ray device component.

15. A method as defined in claim 14, wherein the pressing step is a hot isostatic pressing step.

16. A method as defined in claim 13, further comprising the step of applying a tensile stress to the x-ray device component under conditions to form anisotropically aligned grains therein.

* * * * *

UNITED STATES PATENT AND TRADEMARK OFFICE

CERTIFICATE OF CORRECTION

PATENT NO. : 6,582,531 B2
APPLICATION NO. : 09/934265
DATED : June 24, 2003
INVENTOR(S) : Don Warburton It is certified that error appears in the above-identified patent and that said Letters Patent is hereby corrected as shown below:

Column 5
Line 11, change “characteristics,” to --characteristics.--
Line 21, after “may be” change “uses” to --used--
Line 41, after “connection” change “for” to --with--

Column 7
Line 48, change “'d'” to --' d"--
Line 51, change “'d'” to --' d"--

Column 10
Line 13, change “illustrated” to --illustrative--
Line 22, change “shade” to --shape--

Signed and Sealed this

Twenty-sixth Day of August, 2008

JON W. DUDAS
*Director of the United States Patent and Trademark Office*